US006059017A

United States Patent [19]

Sayegh

[11] Patent Number: 6,059,017

[45] Date of Patent: May 9, 2000

[54] DIRECTIONAL HEAT EXCHANGER

[75] Inventor: Riad Sayegh, Middletown, R.I.

[73] Assignee: The United States of America as represented by the Secretary of the Navy, Washington, D.C.

[21] Appl. No.: 09/062,568

[22] Filed: Apr. 20, 1998

[51] Int. Cl.[7] ..... F28D 15/02

[52] U.S. Cl. ..... 165/41; 165/168; 165/47; 165/80.3; 165/80.4; 165/104.21; 165/104.33; 165/104.25; 114/340

[58] Field of Search ..... 165/41, 44, 168, 165/170, 166, 185, 80.3, 104.21, 169, 47, 80.4, 104.33, 104.25; 114/340

[56] References Cited

U.S. PATENT DOCUMENTS

| | | | |
|---|---|---|---|
| 880,237 | 2/1908 | Obenauer | 165/168 |
| 1,570,316 | 1/1926 | Palermiti | 165/168 |
| 2,627,290 | 2/1953 | Berthelsen | 165/170 |
| 2,990,797 | 7/1961 | Moeller | 165/168 |
| 3,322,190 | 5/1967 | Johnson, Jr. | 165/170 |
| 4,440,151 | 4/1984 | Yamamoto et al. | 165/104.21 |
| 5,314,008 | 5/1994 | Garcia-Mallol | 165/169 |
| 5,423,498 | 6/1995 | Fluegel | 165/41 |

FOREIGN PATENT DOCUMENTS

| | | | |
|---|---|---|---|
| 567960 | 3/1924 | France | 165/44 |
| 2502472 | 7/1976 | Germany | 165/185 |
| 0020321 | 2/1980 | Japan | 165/44 |
| 5-256589 | 10/1993 | Japan | 165/168 |
| 103492 | 1/1916 | United Kingdom | 165/164 |

*Primary Examiner*—John K. Ford
*Attorney, Agent, or Firm*—Michael J. McGowan; James M. Kasischke; Prithvi C. Lall

[57] ABSTRACT

A directional heat exchanger system dissipates heat generated by components contained within a thermally insulated antenna mounted atop a periscope tube. A first wall of thermally conductive material has a first face and a second face with the first face being shaped to substantially contact an internal portion of the periscope tube. A plurality of ribs made from thermally conductive material are fixedly coupled to the second face. A second wall of thermally conductive material opposes the second face of the first wall and is in tangential contact with the ribs to form a fluid seal therewith. At least one channel is formed between the first and second walls. The end of each rib is offset from the end of adjacent ribs such that the channel defines a flow path having a first end and a second end. The components generating heat are thermally coupled to a heat pipe positioned partially in the antenna and partially in the periscope tube. A liquid coolant delivery system is coupled to the first and second ends of the flow path to pump a liquid coolant into the first end and recapture the liquid coolant exiting the second end.

7 Claims, 2 Drawing Sheets

DIRECTIONAL HEAT EXCHANGER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to heat exchangers, and more particularly to a heat exchanger and system constructed to provide a specific direction of heat transfer in order to couple the heat to a preferred heat-dissipating medium.

(2) Description of the Prior Art

Periscopes are one means a submerged submarine uses for communication above the surface. A periscope is designed to reach above the surface while the submarine stays submerged. Many instruments can be embodied in the extreme end of the periscope for communication above the surface. These include the traditional optical periscope, electronic cameras, radio frequency antennas, and laser ranging equipment. Space is limited inside the periscope by the need for extending it above the surface. Accordingly, providing cooling for electronic components embodied in the periscope is difficult.

The electronic components of certain periscope antennas are mounted within a thermally insulated environment, i.e, a radome that is made of one or more special plastics. Currently, these electronic components are cooled passively by natural convection or by conduction. More specifically, heat sinks mounted in the radome are used to spread the heat generated by the electronics over a larger surface area in the radome. However, as operating speeds and capabilities of electronics components increase, the resulting higher thermal loads cannot be adequately dissipated within the radome.

SUMMARY OF THE INVENTION

Accordingly, it is an object of the present invention to provide a heat exchanger for dissipating heat generated within a thermally insulated environment.

Another object of the present invention is to provide a heat exchanger for dissipating heat generated within a limited space.

Yet another object of the present invention to provide a heat exchanger for dissipating heat generated within a periscope antenna by utilizing seawater as a heat sink.

Other objects and advantages of the present invention will become more obvious hereinafter in the specification and drawings.

In accordance with the present invention, a directional heat exchanger includes a first wall and a second wall of thermally conductive material. Each of a plurality of ribs made of thermally conductive material are coupled to the first wall by silver brazing. Each rib is in contact with the second wall. Channels are formed between the first wall and the second wall for receiving a fluid. Heat transfer between the fluid and an ambient environment is transferred primarily from the ribs and the first wall to the ambient environment which can be a periscope tube surrounded by seawater.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
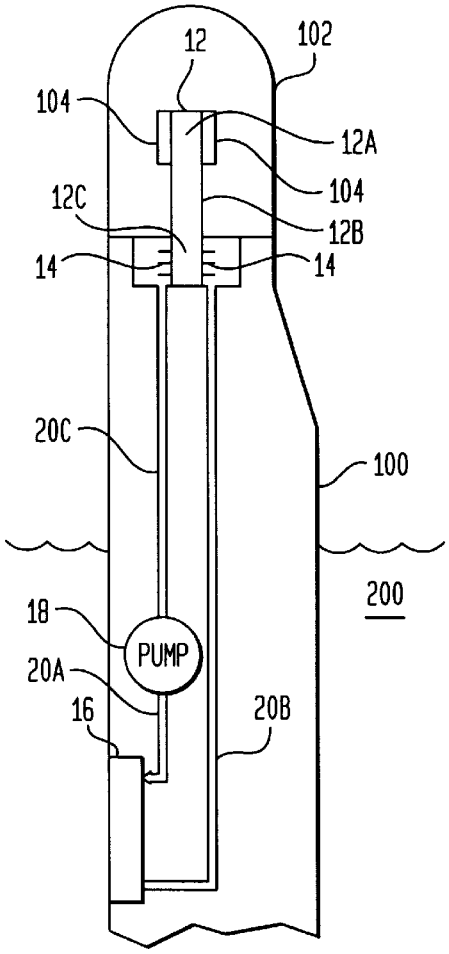
FIG. 1 is a schematic view of the heat exchanger system of the present invention installed in the periscope of a submarine.

Referring now to the drawings, and more particularly to FIG. 1, a heat exchanger and system of the present invention is shown schematically as it would be installed in a periscope tube 100 (shown in portion) having a thermally insulated antenna radome 102 mounted on top of periscope tube 100. The periscope tube 100 is filled with nitrogen or other gases and is substantially immersed in seawater 200. While the present invention is shown and will be described relative to its use with periscope tube 100 and antenna radome 102, it is to be understood that the present invention can be used with other structures in which heat transfer is preferably directed to a large, thermally-conductive heat sink, e.g., seawater.

The system of the present invention includes a heat pipe 12 that resides partially in radome 102 and partially in periscope tube 100. Antenna components 104 that generate heat to be dissipated are coupled for good heat transfer to heat pipe 12 in any one of a variety of ways known in the art. Briefly, heat pipe 12 is a commercially available two-phase heat transfer device with extremely high thermal conductivity. Heat pipe 12 is typically an evacuated tube that is back-filled with a small quantity of working fluid (not shown) such as water. In use, three regions are defined within heat pipe 12. An evaporator region 12A is located where heat is being generated, i.e., in the vicinity of components 104. A condenser region 12C is located in periscope tube 100 where the heat exits heat pipe 12. An adiabatic region 12B is defined between evaporator region 12A and condenser region 12C.

In normal operation, heat generated by components 104 enters heat pipe 12 at evaporator region 12A thereby causing the working fluid to vaporize. The vaporized working fluid creates a pressure gradient which forces the vapor through adiabatic region 12B to condenser region 12C. As heat exits heat pipe 12 at condenser region 12C (as will be explained further below), the vaporized working fluid condenses and is drawn back into the pores of a wick (not shown) in heat pipe 12 for return to evaporator region 12A. Such heat pipes are known in the art and are available commercially available from Thermacore Inc., Lancaster, Pa. Thermally conductive fins 14 can be mounted onto heat pipe 12 at condenser region 12C to enhance heat transfer from heat pipe 12.

A heat exchanger 16 of the present invention is coupled to the inside wall of periscope tube 100 in an area thereof that will be immersed in seawater 200 during the operation of antenna components 104. In general, heat exchanger 16 is shaped to conform to the shape of the inside wall of periscope tube 100 to achieve substantial or complete physical contact therebetween. A liquid coolant delivery system couples condenser region 12C to heat exchanger 16. More specifically, a pump 18 pumps liquid coolant into heat exchanger 16 via conduit 20A. The liquid coolant passes through heat exchanger 16 and is pumped through conduit 20B to pass over condenser region 12C of heat pipe 12 and, if present, fins 14 before returning to pump 18 via conduit 20C.

Figure 2:
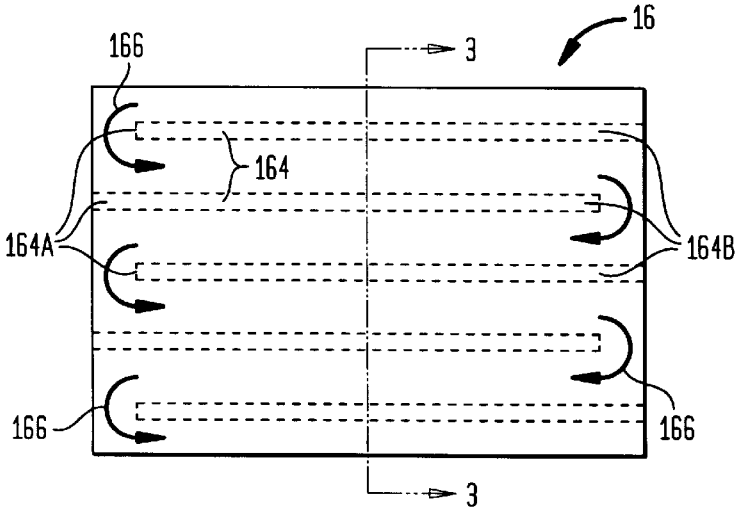
FIG. 2 is a plan view of the heat exchanger.
Figure 3:
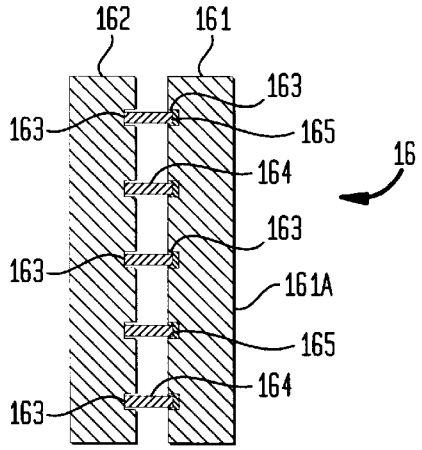
FIG. 3 is a cross-sectional view of the heat exchanger taken along line 3—3 of FIG. 2.

The novel construction of heat exchanger 16 will now be described with simultaneous reference to FIGS. 2, 3 and 4. Heat exchanger 16 has a first wall 161 and a second wall 162, both of which are made from a thermally conductive material such as aluminum 6061 or beryllium copper. Opposing faces of walls 161 and 162 are grooved at 163 to receive opposing edges of a plurality of ribs 164. Each of ribs 164 is also made of a thermally conductive material. This material should be the same as walls 161 and 162. Ribs 164 are each coupled to wall 161 for good heat transfer therebetween. This is accomplished by silver brazing (indicated at 165) one edge of each rib 164 into a corresponding groove 163. Silver brazing 165 thus fixedly couples ribs 164 to wall 161 and enhances the heat transfer from ribs 164 to wall 161. As an alternative, ribs 164 can be formed as part of wall 161. Grooves 163 in wall 162 are provided to receive the other edge of each rib 164. However, no silver brazing is applied to the interface between wall 162 and ribs 164. It is only necessary to achieve a fluid sealing contact between wall 162 and ribs 164.

Walls 161 and 162 can be made from materials having different heat transfer properties; however, these differing materials must allow for bonding and expansion. Accordingly, it is preferred that these walls 161 and 162 be made from the same material. Wall 162 can then be insulated from transferring heat into the interior of periscope tube 100, if such heat transfer is undesirable.

The ends of adjacent ribs are staggered or offset from one another. More specifically, adjacent ones of ends 164A are offset from one another as are adjacent ones of ends 164B. In this way ribs 164 define a zigzag path as indicated by arrows 166. Then, by sealing off heat exchanger 16 at either end of walls 161 and 162, a zigzag fluid flow path is defined within heat exchanger 16. Sealing at the ends of walls 161 and 162 can be accomplished with end walls 167 and 168 which can be individual pieces attached to the ends of walls 161 and 162, can be made integral with one of walls 161 or 162, or can be formed from shaped extensions of ribs 164. Wall 168 has two apertures 168A and 168B formed therein in communication with flow path 166. Conduit 20A is coupled to one end of zigzag flow path 166 at aperture 168A and conduit 20C is coupled to the other end of zigzag flow path 166 at aperture 168B. The end wall apertures and flow path could also be arranged with one aperture in each end wall, e.g., end wall 168 could be provided with one aperture 168A while end wall 167 could be provided with one aperture 167B which is illustrated in dashed line form to indicate its use in the alternative.

Figure 4:
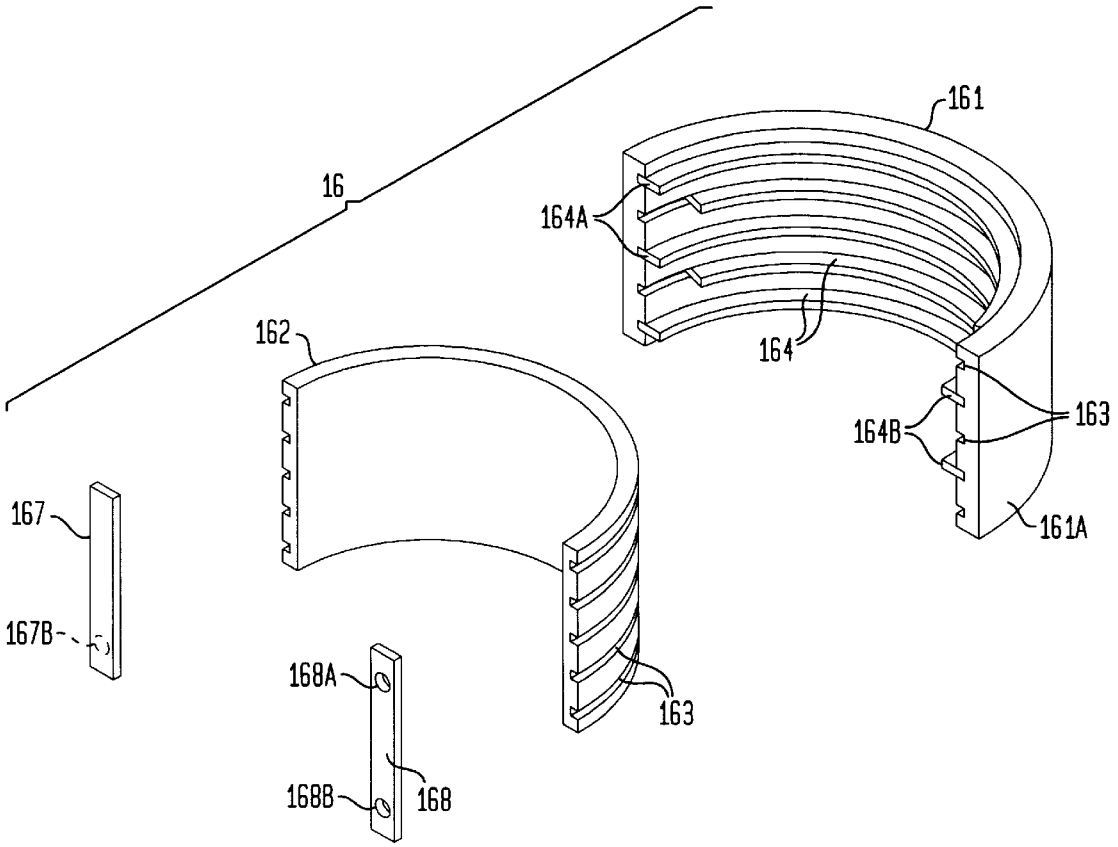
FIG. 4 is an exploded perspective view of a typical construction of the heat exchanger configured for installation in a periscope tube.

As shown in FIG. 4, at least the outer face 161A of 161 is shaped to conform completely or substantially to the inside wall of periscope tube 100 to which it is mounted. For example, in the case of a cylindrical periscope tube 100, outer face 161A is shaped to conform or nest against the inner cylindrical wall of periscope tube 100. Heat carried by the liquid coolant entering heat exchanger 16 is readily transferred from ribs 164 through silver brazing 165, wall 161 and periscope tube 100 to be readily dissipated into seawater 200. Another heat transfer path is provided by the surface of wall 161 between grooves 163. Heat flows out of the fluid and through wall 161 directly by this path. In contrast, since nitrogen or other gases in periscope tube 100 do not conduct heat well, and since ribs 164 are not coupled to wall 162 for good heat transfer, little heat will be transferred from ribs 164 through wall 162 into the gaseous environment within periscope tube 100. Thus, heat exchanger 16 is capable of achieving directional control of heat transfer in order to take advantage of the best available heat sink.

The advantages of the present invention are numerous. A simple, compact heat exchanger and system provide for directional control of heat transfer to a preferred heat sink. In terms of heat generated with periscope mounted antennas, the present invention provides a simple and space efficient heat-dissipation solution.

Although the present invention has been described relative to a specific embodiment it is not so limited. For example, each of ribs 164 could be made integral with wall 161, although such construction would probably add to the overall tooling cost of the device. Furthermore, the device could cover a larger arc and be made to a different conforming shape. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A heat exchanger system for dissipating heat generated by components contained within a thermally insulated antenna mounted atop a periscope tube, comprising:

a first wall of thermally conductive material having a first face and a second face, said first face shaped to substantially contact an internal portion of said periscope tube;

a plurality of ribs made from thermally conductive material fixedly coupled to said second face of said first wall for good heat transfer therebetween;

a second wall of thermally conductive material opposing said second face of said first wall and in tangential contact with said plurality of ribs to form a fluid seal therewith, wherein at least one channel is formed between said first wall and said second wall;

said plurality of ribs each having two ends, each said end being offset from each end of adjacent ones of said plurality of ribs such that said at least one channel defines a flow path having a first end and a second end;

a heat pipe residing partially in said thermally insulated antenna and partially in said periscope tube, wherein said components generating heat are thermally coupled to said heat pipe; and a liquid coolant delivery system coupled to said first end and said second end of said flow path, said liquid coolant delivery system pumping a liquid coolant into said first end and recapturing said liquid coolant exiting said second end, said liquid coolant delivery system passing said liquid coolant exiting said second end over a portion of said heat pipe in said periscope tube, wherein heat transfer between said liquid coolant and an ambient environment is transferred primarily from said plurality of ribs through said first wall and said periscope tube.

2. A heat exchanger system as in claim 1 wherein said plurality of ribs are integral with said first wall.

3. A heat exchanger system as in claim 1 wherein each of said plurality of ribs is fixedly coupled all along one edge thereof to said first wall by silver brazing.

4. A heat exchanger system as in claim 3 wherein said first wall incorporates grooves for receiving said silver brazing and said one edge of each of said plurality of ribs.

5. A heat exchanger system as in claim 3 wherein said second wall incorporates grooves for receiving another edge of each of said plurality of ribs opposite said one edge.

6. A heat exchanger system as in claim 1 further comprising heat transfer fins coupled to said portion of said heat pipe residing in said periscope tube over which said liquid coolant is passed.

7. A heat exchanger system as in claim 1 wherein said thermally conductive material is selected from the group consisting of aluminum 6061 and beryllium copper.

* * * * *